US006263950B1

(12) United States Patent
Jones

(10) Patent No.: US 6,263,950 B1
(45) Date of Patent: Jul. 24, 2001

(54) LOST FOAM CASTING USING DIMENSIONALLY SELF-STABILIZED PATTERN

(75) Inventor: Marie-Christine G. Jones, Bingham Farms, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/276,857

(22) Filed: Mar. 26, 1999

(51) Int. Cl.[7] ..... B22C 7/02; B22C 9/04

(52) U.S. Cl. ..... 164/34; 164/45; 164/246; 264/DIG. 9

(58) Field of Search ..... 164/34, 45, 246; 264/53, 126, DIG. 9, DIG. 15

(56) References Cited

U.S. PATENT DOCUMENTS

| | | | | |
|---|---|---|---|---|
| 2,983,692 | | 5/1961 | D'Alelio | 260/2.5 |
| 3,027,334 | | 3/1962 | Wright | 260/2.5 |
| 3,027,335 | | 3/1962 | Wright | 260/2.5 |
| 3,060,138 | | 10/1962 | Wright | 260/2.5 |
| 4,269,871 | * | 5/1981 | Blommers et al. | 427/222 |
| 4,790,367 | * | 12/1988 | Moll et al. | 164/34 |
| 4,816,199 | * | 3/1989 | Matz et al. | 264/53 |
| 5,041,465 | * | 8/1991 | Sonnenerg | 521/58 |
| 5,385,698 | * | 1/1995 | Bishop et al. | 264/53 |
| 5,403,866 | * | 4/1995 | Kato et al. | 521/98 |
| 5,591,778 | * | 1/1997 | Scherzer et al. | 521/56 |
| 5,755,271 | * | 5/1998 | Williamson | 164/34 |

FOREIGN PATENT DOCUMENTS

| | | | | |
|---|---|---|---|---|
| 0 634 444 | * | 1/1995 | (EP) | C08J/9/16 |
| 0 683 198 | * | 11/1995 | (EP) | C08J/9/18 |

OTHER PUBLICATIONS

Immel, R. H., "Expandable Polystyrene and Its Processing into Patterns for the Evaporative Casting Process", American Foundrymen's Society Transactions, 79–03, 1979, pp. 545–550.*

Niemann, E. H., "Expandable Polystyrene Pattern Material for the Lost Foam Process", American Foundrymen's Society Transactions, 88–33, 1988, pp. 793–798.*

Piwonka, T. S., "A Comparison of Lost Pattern Casting Processes", Materials & Design, vol. 11, No. 6, 1990, pp. 283–290.*

Stroom, P. A., "Designing for Lost Foam", Foundry Management & Technology, Apr. 1995, pp. 30–34.*

A Comparison of Lost Pattern Casting Processes; Materials & Design, vol. 11, (6), Dec. 1990, pp. 283–290, Piwonka.

A Study of Weight Loss Rates of EPC Patterns During Storage; AFS Transactions, 91–73, pp. 411–414, Reddy et al. (1991).

The Indentation of Foam Pattern Surfaces by Coordinating Measuring Machine Probes; AFS Transactions, 91–74, pp. 287–290, Nenawati et al. (1991).

Designing for Lost Foam; Foundry Management & Tech.; Apr. 1995, pp. 30–34, Stroom.

Process Control for Precision Lost Foam Casting—Part 1; Foundry Management & Tech.; Dec. 1996, pp. 37–40, Littleton et al.

The Micorscopical Examination of Molded and Extruded Polystyrene Foams; Resinography of Cellular Plastics, pp. 53–68, Ingram et al. (1967).

Some effects of Composition on Foam Structures from Expandable Polystyrene Beads; 7th Annual Technical Conference, Cellular Plastics Division SPI, Apr. 24–25, 1963, pp. 1–6, Ingram et al. (no date).

Composition of Foam Structures from Expandable Polystyrene Beads; Modern Plastics 41 (3), Nov. 1963, pp. 152–203, Ingram et al.

The Full–mould Process—a Review; Foundry Trade Journal, Jul. 6, 1978, pp. 149–160, Clegg.

Expandable Polystyrene and Its Processing into Patterns For the Evaporative Casting Process; AFS Transactions, 79–03, pp. 545–550, Immel. (1979).

Expandable Polystyrene Pattern Material for the Lost Foam Process; AFS Transactions, 88–33, pp. 793–798, Niemann, (1988).

Evaporative Pattern Casting: Factors Affecting Expandable Polystyrene (EPS) Pattern Shrinkage; AFS Transactions, 90–116, pp. 367–370, Niemann et al. (1990).

* cited by examiner

*Primary Examiner*—Tom Dunn
*Assistant Examiner*—Kevin P. Kerns
(74) *Attorney, Agent, or Firm*—Lawrence B. Plant

(57) ABSTRACT

The method of lost foam casting uses a polystirene foam pattern molded from polystirene beads preexpanded from raw polystirene beads that have a raw bead diameter in the range of about 0.1 to about 0.6 millimeters and that include isopentane as a relatively slow diffusing blowing agent alone, or together with normal pentane as a relatively high diffusing blowing agent, the isopentane being present in an amount of at least about 40% by weight of the total blowing agent of the raw beads to significantly reduce post-molding dimensional pattern shrinkage and to render the molded patterns inherently more dimensionally stable. The patterns can be used directly in the lost foam casting of molten metal without the need for any intermediate pattern dimension-stabilizing treatment.

8 Claims, 12 Drawing Sheets

LOST FOAM CASTING USING DIMENSIONALLY SELF-STABILIZED PATTERN

FIELD OF THE INVENTION

The present invention relates to lost foam casting and, more particularly, to lost foam casting using a dimensionally self-stabilized polystirene foam pattern.

BACKGROUND OF THE INVENTION

The lost foam casting process is a well known method of producing metal castings of complex shape wherein an expanded polymeric foam pattern is embedded in a mold typically comprising unbonded foundry sand, and molten metal is poured into the mold to evaporate and displace the pattern in the mold. The dimensions of the casting closely reflect the original dimensions of the foam pattern that the metal replaces. Thus, it is important to use patterns as dimensionally accurate and stable as possible.

The polymeric foam pattern is obtained by molding pre-expanded polystirene or other polymer beads in a pattern mold to impart the desired configuration to the pattern. For example, a commonly used material for making polymeric foam patterns comprises expandable polystirene (EPS) raw beads that contain a blowing agent that typically includes mostly normal pentane with other alkanes also present (e.g. some raw beads are supplied with up to about 30% by weight alkanes other than normal pentane) and that have a raw bead size distribution with over 90% of the beads having a bead diameter in the range of about 0.2 to 0.5 millimeters. These are referred to as T-beads and are needed to provide a satisfactory pattern surface and to allow formation of thin-walled patterns, such as for example only, patterns with wall thicknesses of approximately 3 to 5 millimeters for casting vehicle engine blocks. The EPS raw beads are pre-expanded at a temperature above the softening temperature of polystirene and above the boiling point of the blowing agent. The pre-expanded EPS beads then are molded into the desired configuration in a pattern mold that is steam heated to further expand the beads and then water cooled to stop the expansion process after the pattern is formed to shape. The pattern then is removed from the mold.

Upon removal from the mold into the ambient atmosphere, such polystirene foam patterns are known to initially grow in size as air diffuses into the pattern and then to shrink in size. In the past, conventional lost foam casting practice involved storing the molded polystirene foam patterns for an extended amount of time (e.g. 30 days) at room temperature until dimensional equilibrium was approached, and then to proceed with use of the patterns in casting molten metal. Another practice involves preexpanding EPS beads, molding the beads to form a desired pattern, and then subjecting the pattern to oven aging to rapidly bring the pattern to stable dimensions.

A method to more rapidly stabilize pattern dimensions is described in U.S. Pat. No. 5,385,698 where pre-expanded EPS beads are expanded from dense raw beads and heated for a time prior to molding to form a desired pattern.

Another attempt to rapidly dimensionally stabilize the patterns described in U.S. Pat. No. 4,816,199 involves pre-expanding EPS beads, molding the expanded beads to form a desired pattern, and then subjecting the molded pattern to subatmospheric pressure in the range of 2–20 inches Hg for at least 5 hours to rapidly bring the pattern to stable dimensions.

An object of the present invention is to provide a method of lost foam casting using an improved dimensionally self-stabilized polystirene foam pattern that permits direct use of the pattern in the lost foam casting of molten metal without the need for the post-molding, dimension-stabilizing pattern treatments described above.

SUMMARY OF THE INVENTION

The present invention provides a method of lost foam casting that uses a foam pattern molded from polystirene beads expanded from raw polystirene beads that have a raw bead diameter selected to provide a satisfactory pattern surface and to allow formation of thin-walled patterns, and that include a relatively slow-diffusing blowing agent in an amount of at least about 40% by weight of the blowing agent present in the raw beads to render the pattern inherently more dimensionally stable over time after pattern molding. The weight percentage of the blowing agent is with reference to the dense raw polystirene beads prior to preexpansion to produce the expanded beads. The dimensionally self-stabilized pattern can be used directly in the lost foam casting of molten metal without an intermediate post-molding dimension-stabilizing pattern treatment. For example, the pattern can be embedded in a mold comprising refractory particulates, such as foundry sand, and molten metal can be gravity or countergravity cast in a manner to replace the pattern in the mold.

An illustrative embodiment of the present invention involves molding of the pattern from polystirene beads preexpanded from raw polystirene beads that have a raw bead size distribution with bead diameters in the range of about 0.1 to about 0.6 millimeters to produce patterns with thin walls and satisfactory pattern surface finish and that include isopentane as a relatively slow diffusing blowing agent alone, or together with normal pentane (n-pentane) as a relatively fast-diffusing blowing agent (diffusivity properties being with respect to the polystirene matrix of the molded pattern) to render the pattern inherently more dimensionally stable over time. When isopentane and normal pentane are used together, the isopentane blowing agent is present in an amount of about 40% by weight or more of the total of the blowing agent, preferably about 50% to 70% by weight of total blowing agent, present in the raw beads. The dimensionally self-stabilized patterns exhibit reduced shrinkage over time after molding and an extended shelf life before pattern shrinkage occurs beyond a preselected pattern shrinkage tolerance. The patterns can be used in the lost foam casting process during this extended shelf life without the need for any intermediate stabilizing treatment, such as long term ambient aging, accelerated oven aging, or accelerated vacuum treatment, used heretofore to rapidly stabilize post-molding pattern dimensions.

The above and other objects and advantages of the present invention will become more readily apparent from the following detailed description taken in conjunction with the following drawings.

DESCRIPTION OF THE INVENTION

Figure 1:
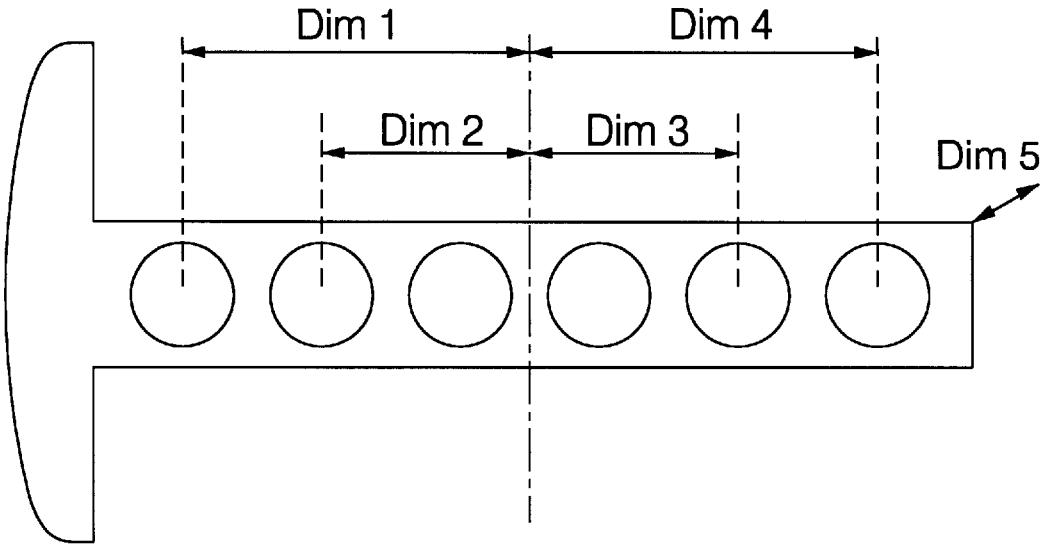
FIG. 1 is a schematic of the molded pattern illustrating the selected dimensions 1 through 5 referred in the FIGS. 3–5.

The present invention involves in an embodiment a method of lost foam casting that uses a polystirene foam pattern molded from polystirene beads expanded from dense raw polystirene beads that have a raw (unexpanded) bead diameter in the range of about 0.1 to about 0.6 millimeters (mm) selected to produce patterns with thin walls, such as for example only, pattern wall thicknesses of approximately 3 to 5 millimeters that are used for casting vehicle engine blocks, and a satisfactory pattern surface finish for casting and that include a relatively slow-diffusing blowing agent in an amount of at least about 40% by weight of the blowing agent present in the raw beads prior to preexpansion to render the pattern molded therefrom inherently more dimensionally self-stable over time after pattern molding. The dimensionally self-stabilized pattern can be used directly in the lost foam casting of molten metal without an intermediate post-molding dimension-stabilizing pattern treatment before a preselected pattern shrinkage tolerance is exceeded. The invention is not limited to any particular pattern dimensions or shapes and can be practiced to make dimensionally self-stabilized patterns for use in casting a wide variety of metal or alloy components.

A particular illustrative embodiment of the present invention involves molding of the pattern from beads that comprise polystirene homopolymer and that have a raw bead size distribution with substantially all of the raw beads having a bead diameter in the range of about 0.1 to about 0.6 millimeters to produce patterns with thin walls and satisfactory pattern surface finish and that include isopentane as a relatively slow diffusing blowing agent alone, or together with normal pentane as a relatively fast-diffusing blowing agent, the diffusivity properties being with respect to the polystirene matrix of the molded pattern. When isopentane and normal pentane are used together, the isopentane blowing agent preferably is present in an amount of about 40% or more of the total of the blowing agents, even more preferably from about 50% to about 70%, of the total blowing agents, in the raw polystirene beads. For example, a molded polystirene foam pattern for use in lost foam metal casting includes isopentane blowing agent alone or together with normal pentane with the isopentane blowing agent being present in amount to provide reduced pattern shrinkage for a period of days following pattern molding as the examples set forth below illustrate. The invention envisions use of other slow-diffusing blowing agents in lieu of or in addition to isopentane, such as 2,2 dimethyl, propane (neopentane), cyclopentane, 2,2 dimethyl butane, 2,3 dimethyl-butane, hexane, cyclohexane, 2 methylpentane, 3 methylpentane as well as mixtures of one with another and/or with isopentane. The invention will be described in further detail below with respect to expandable polystirene beads of so-called T size and normal pentane and/or isopentane blowing agents.

The following detailed example is offered to further illustrate, but not limit, the present invention. Experimental raw expandable polystirene (EPS) beads having a bead size distribution with greater than 90% of the beads having bead diameters in the range of about 0.2 to 0.5 millimeters (mm) designated commonly as T type beads, and containing different blowing agents were evaluated. For example, EPS T type beads having pure normal pentane blowing agent were evaluated as representative of conventional lost foam pattern practice. EPS T type beads pursuant to the invention having pure isopentane (also known as 2 methyl butane) blowing agent, and other EPS T type beads pursuant to the invention having mixture of 40% by weight normal pentane and 60% by weight isopentane as the blowing agent were evaluated. These experimental EPS beads containing the various blowing agents were provided by Styrochem International Corporation, Fort Worth, Tex.

The isopentane blowing agent used in practice of the invention exhibits slow diffusivity in the polystirene matrix to reduce pattern shrinkage, a vapor pressure at pre-expansion and molding temperatures similar to that of normal pentane, and a low relative cost. Both isopentane and normal pentane have the chemical formula $C_5H_{12}$, but normal pentane is a linear molecule, whereas isopentane is a branched molecule. Isopentane has a boiling point of 27.8 degrees C. versus 36.1 degrees C. for normal pentane. The expanding power of isopentane is slightly greater than that of normal pentane; i.e., the vapor pressure of isopentane at 100 degrees C. being 113 psi as compared to 91 psi for normal pentane.

The experimental raw EPS beads were pre-expanded in a dry-pre-expander in a manner described in US Patent 5 385 698 to a density of 1.4 pcf (pounds per cubic foot). The pre-expanding treatment can be conducted in apparatus and using parameters described in U.S. Pat. No. 5,385,698, the teachings of which are incorporated herein by reference to obtain the prepuff (pre-expanded beads) with desired prepuff density. The blowing agent content of the prepuff prior to molding was 3.1% to 3.2% by weight. The prepuff having the isopentane blowing agent were aged in an oven at 43 degrees C. to achieve the target blowing agent content in the beads.

From each experimental EPS bead sample, fifteen patterns shown schematically in FIG. 1 were molded in a Styrologic vertical acting, horizontal parting 80×60 mm molding machine available from Styrologic, a division of Vulcan Engineering Company, Helena, Ala., each pattern comprising six cylinders as shown. Molding parameters were standard parameters used heretofore to mold conventional polystirene patterns. Additional patterns were molded and used to monitor the blowing agent content of the patterns. All of the patterns were stored and evaluated at room temperature for a month after molding. Five pattern dimensions illustrated in FIG. 1 were measured as a function of aging time. Dimensions 1 and 4 initially were about 244 mm, while dimensions 2 and 3 initially were about 146.4 mm. Dimension 5 is pattern thickness taken in a direction perpendicular to the plane of the drawing, FIG. 1, and initially was about 66 mm. The measurement was conducted using a conventional coordinate measuring machine with contact probes.

Table I shows the blowing agent weight percentage as well as percentage of normal pentane in the blend in the raw and pre-expanded polystirene beads and in the molded patterns as a function of aging time. The data of Table I was obtained with a gas chromatograph.

TABLE I

| % BA in PS | raw beads | prepuff/ preexp | prepuff/ molding | pattern day 0 | pattern day 2 | pattern day 4 | pattern day 13 | pattern day 22 | pattern day 28 |
|---|---|---|---|---|---|---|---|---|---|
| N-pentane | 5.65 | 3.91 | 3.14 | 2.80 | 1.10 | 0.84 | 0.35 | 0.16 | 0.18 |
| I-pentane | 5.91 | 4.80 | 3.18 | 3.16 | 2.68 | 2.33 | 1.55 | 1.24 | 0.91 |
| Blend of N and I | 6.07 | 4.75 | 3.20 | 3.09 | 2.39 | 2.10 | 1.52 | 1.11 | 0.93 |
| % N-pentane in Blend | 38.0 | 32.6 | 16.4 | 14.1 | 5.5 | 2.6 | 0.2 | 0 | 0 |

Figure 2:
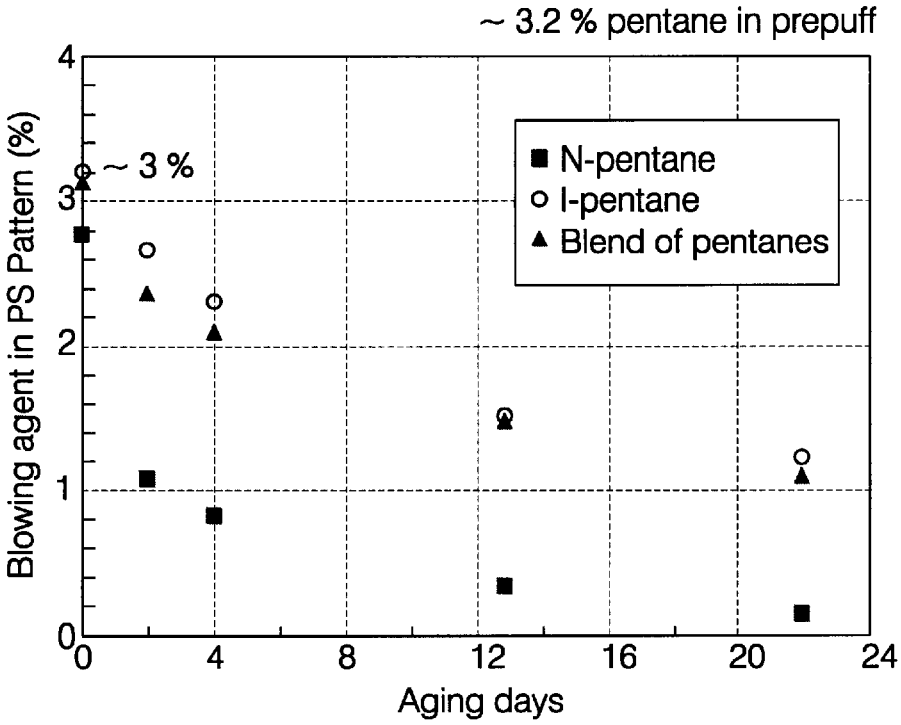
FIG. 2 is a graph illustrating loss of various blowing agents over time from the polystirene pattern of FIG. 1 where N-pentane is normal pentane and I-pentane is isopentane.
Figure 3A:
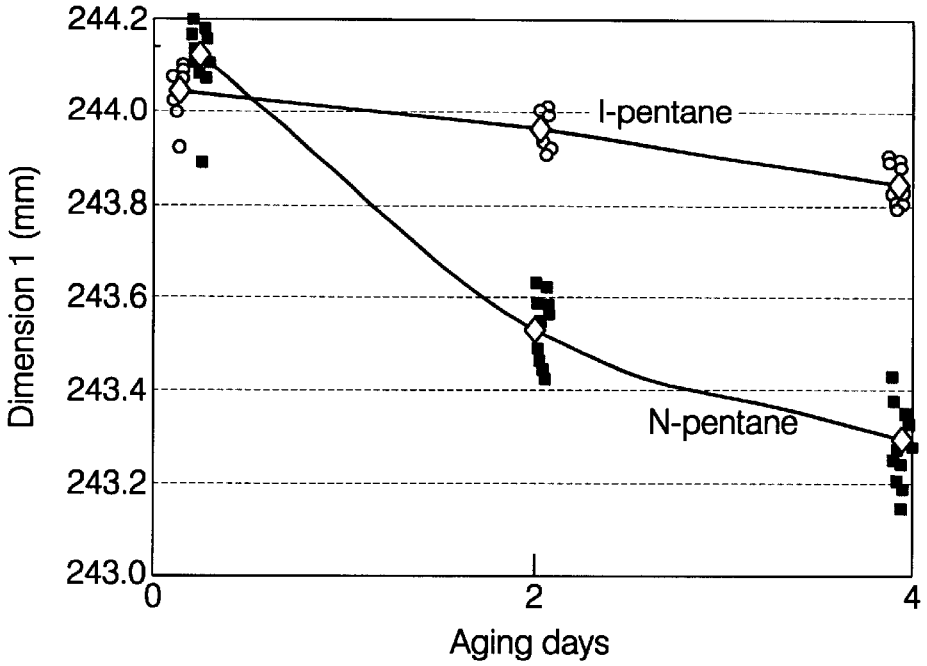
FIGS. 3A through 3E are graphs showing change of dimensions 1 through 5, respectively, of the molded pattern versus time in days where a data point is provided for each of fifteen patterns.
Figure 3B:
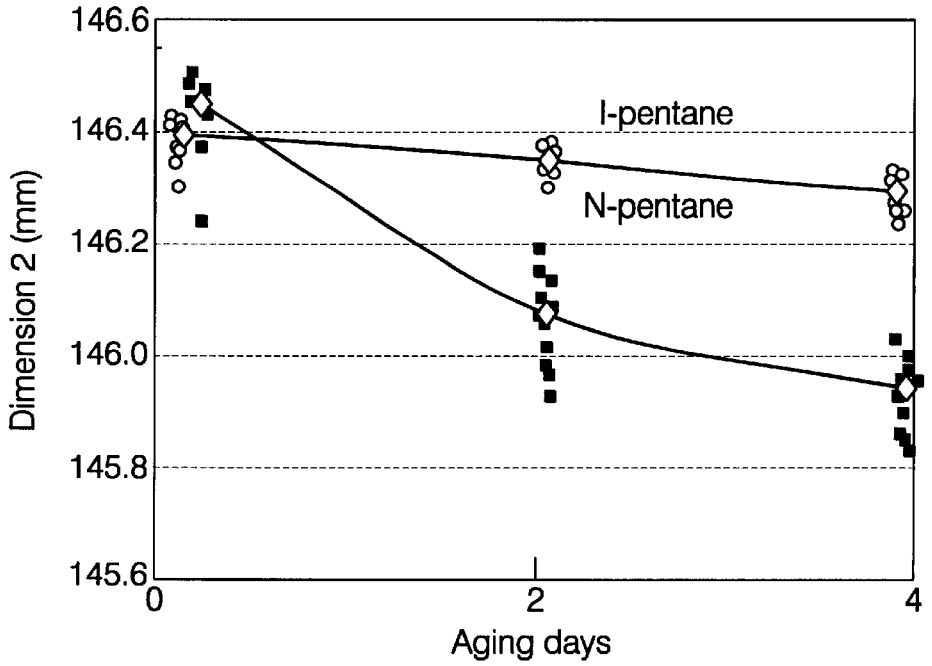
Figure 3C:
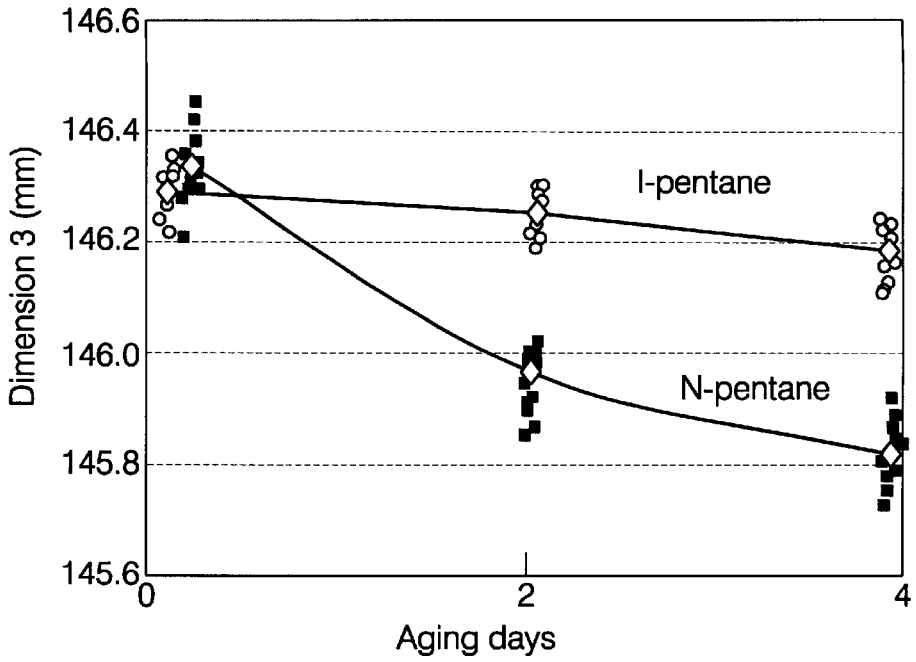
Figure 3D:
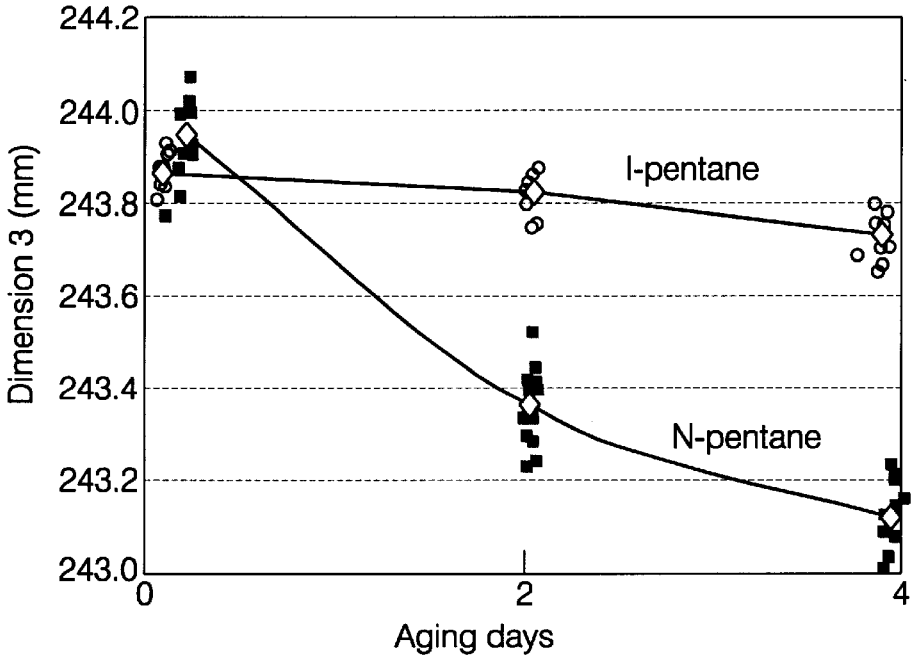
Figure 3E:
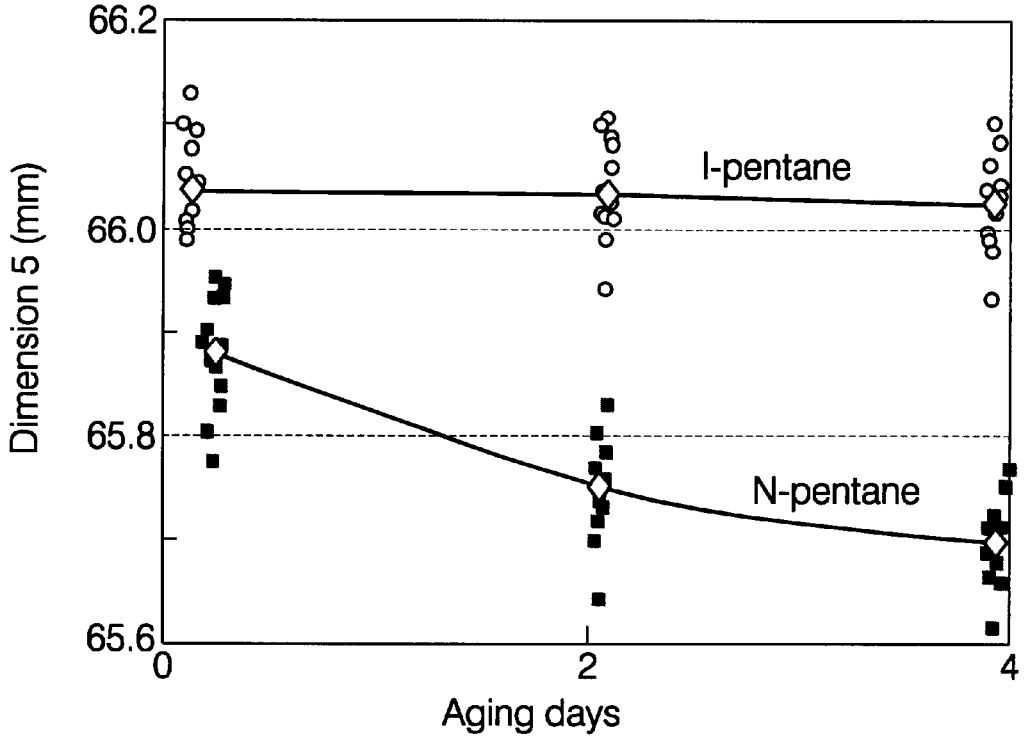
Figure 4A:
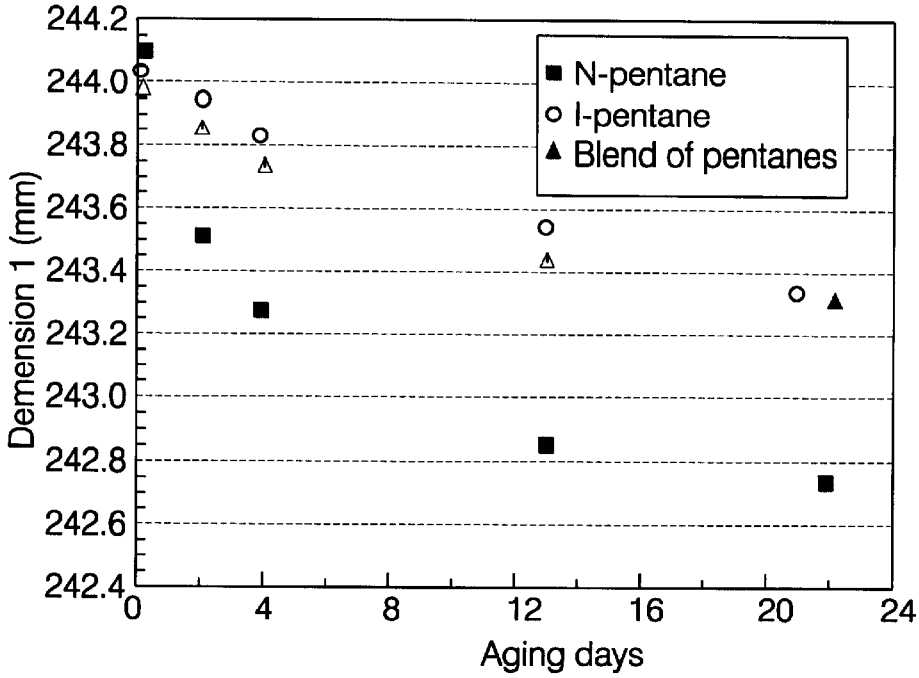
FIGS. 4A through 4E are graphs showing change of average dimensions 1 through 5 of fifteen molded patterns over time.
Figure 4B:
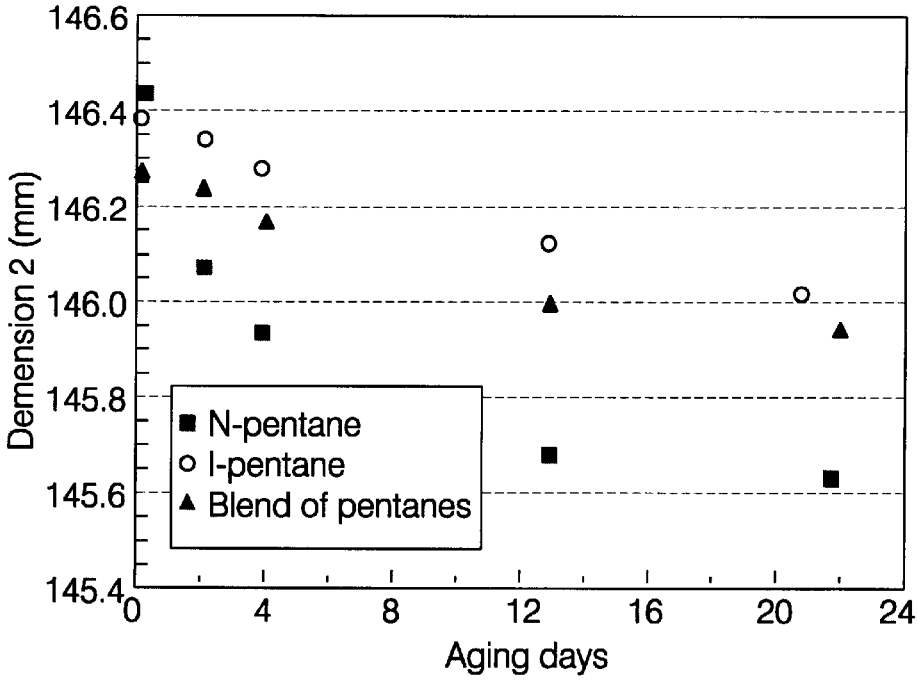
Figure 4C:
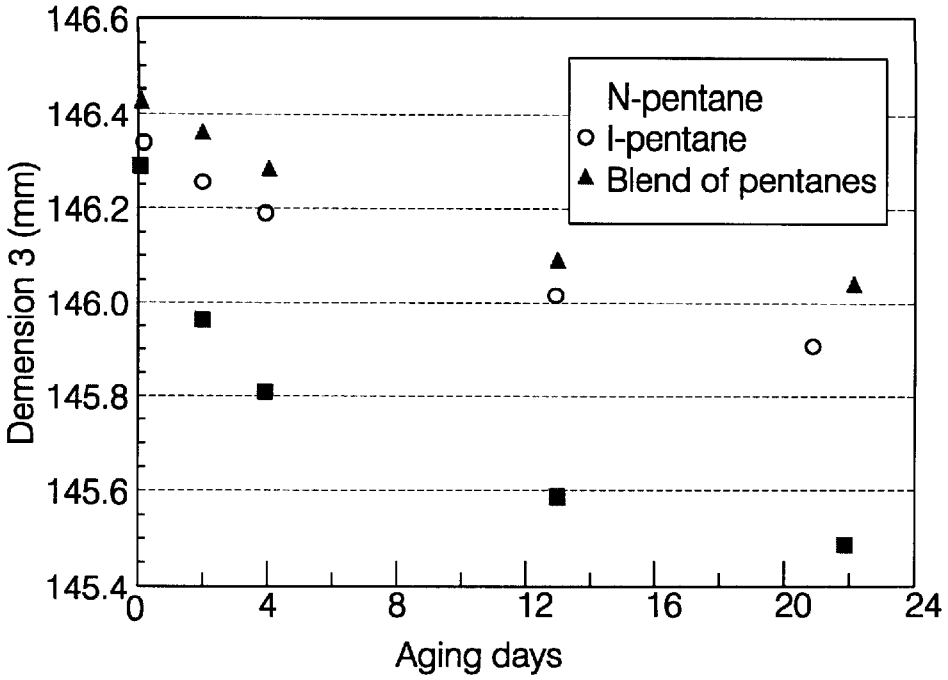
Figure 4D:
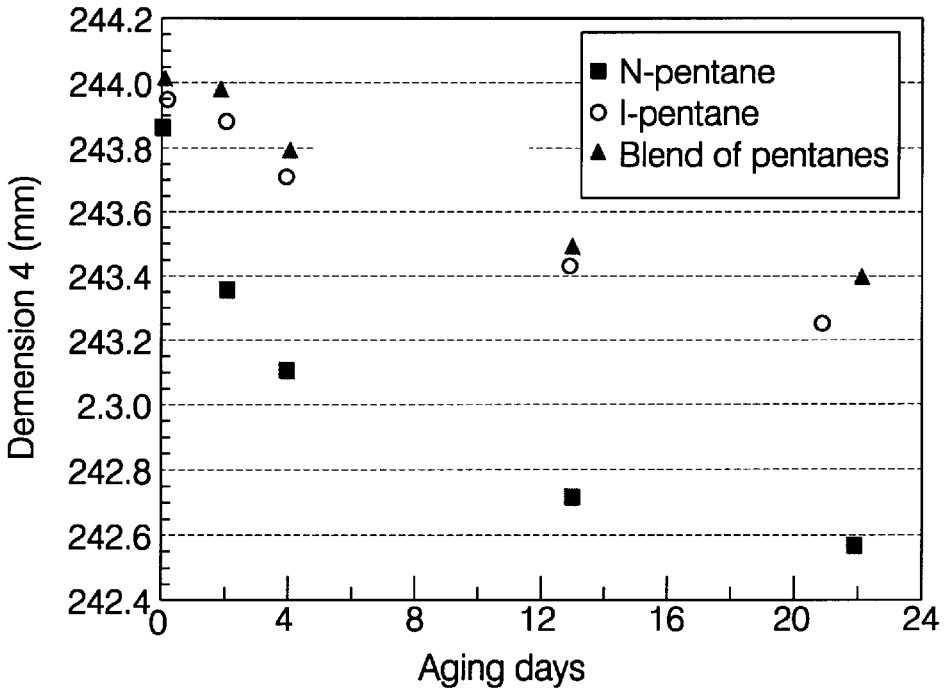
Figure 4E:
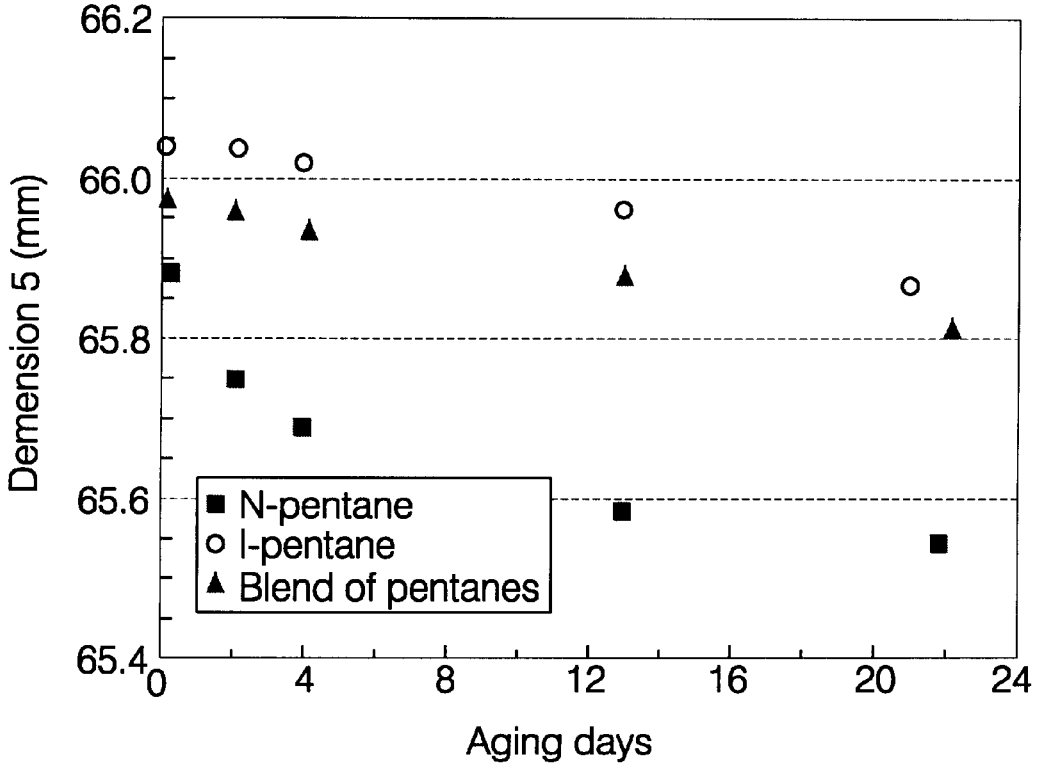
Figure 5A:
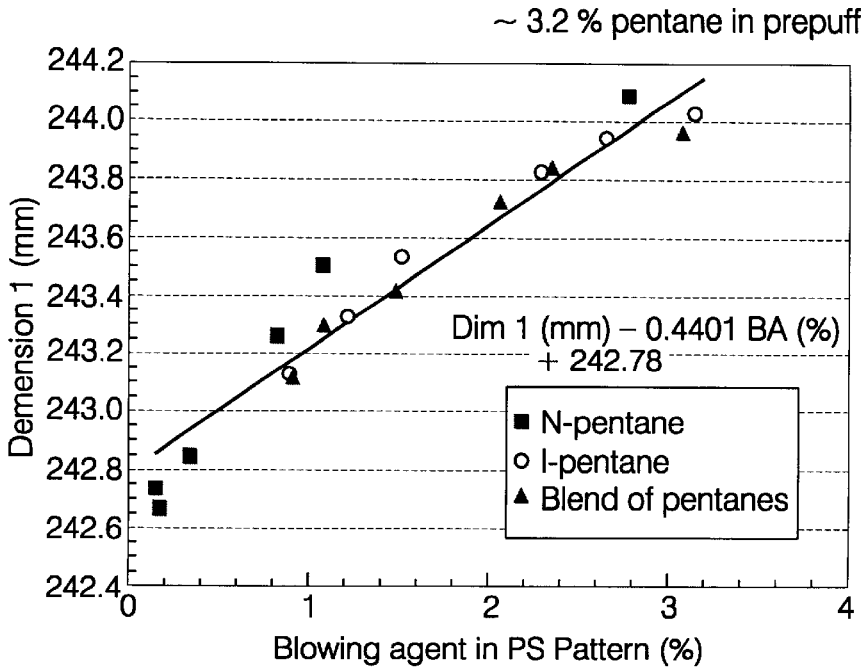
FIGS. 5A through 5E are graphs of average pattern dimensions versus concentration of blowing agent for dimensions 1 through 5, respectively, of the patterns.
Figure 5B:
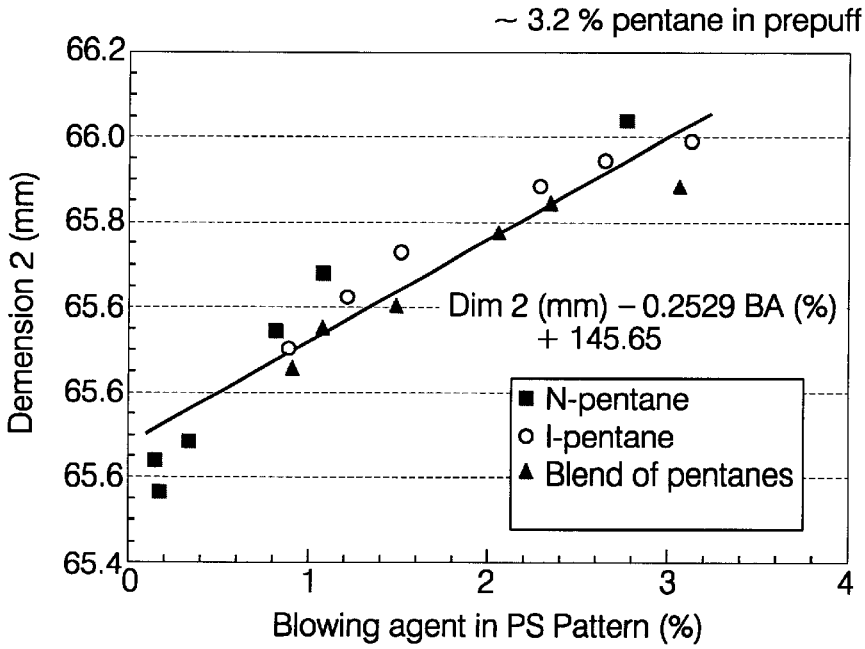
Figure 5C:
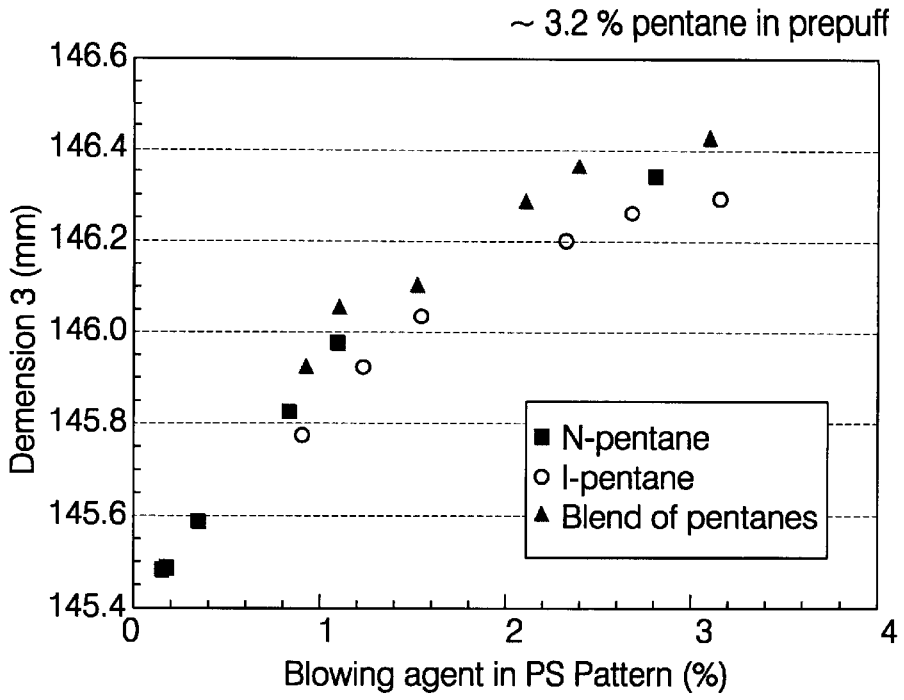
Figure 5D:
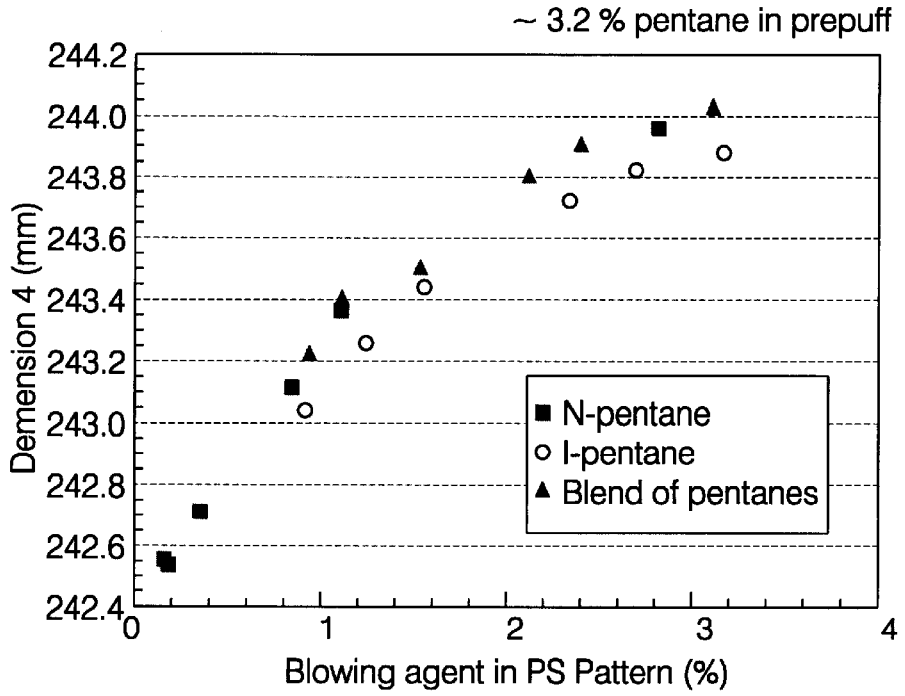
Figure 5E:
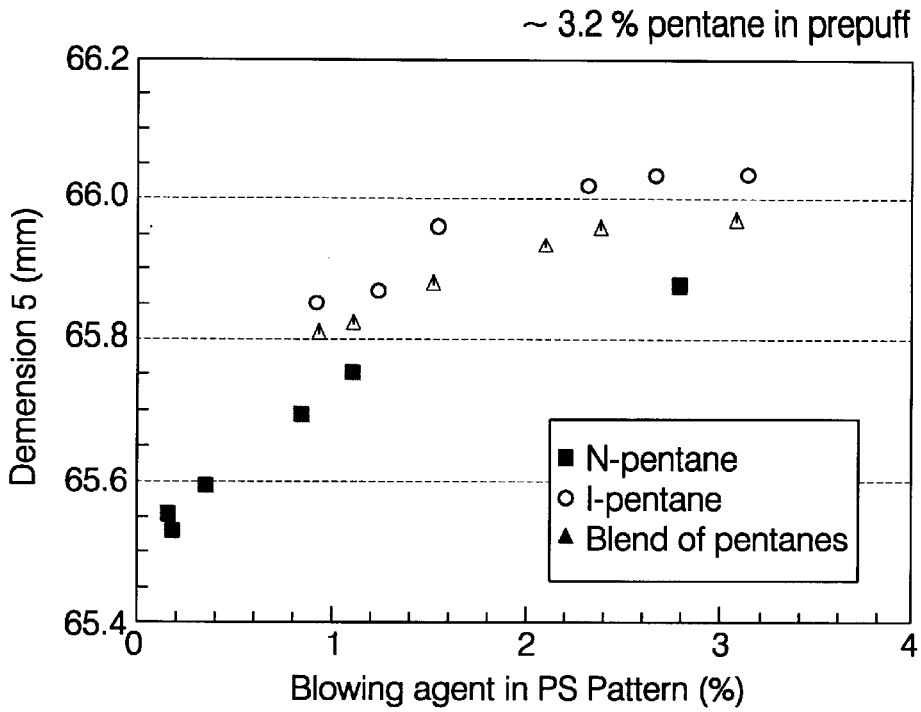

BA is blowing agent where N-pentane is normal pentane and I-pentane is isopentane
prepuff/ preexp: expanded beads just after preexpansion
prepuff/ molding: expanded beads just before molding The loss of blowing agent out of the patterns is graphically shown in FIG. 2.

From Table I and FIG. 2, the diffusion of isopentane is much slower than that of normal pentane from the polystirene pattern. The blowing agent originally comprising 40% by weight normal pentane and 60% by weight isopentane diffuses out of the pattern in a manner similar to the pure isopentane blowing agent as a result of the composition of the blowing agent in the pattern exiting the molding machine being 86% by weight isopentane. The original 40% normal pentane and 60% isopentane becomes nearly pure isopentane as the molded patterns age.

The changes in the five dimensions with aging at room temperature are shown in FIGS. 3A through 3E and FIGS. 4A through 4E. FIGS. 3A–3E include all data points for the 15 patterns for the first four days of aging. FIGS. 4A–4E show the average dimensions for 24 aging days. The foam patterns shrink in an exponential manner with aging time, and a strong dependence of shrink rate with blowing agent type was observed. The isopentane containing patterns shrink more slowly than the normal pentane containing patterns. The molded patterns with the blend of normal pentane and isopentane shrink in a manner similar to the patterns containing the isopentane blowing agent.

The difference in shrink rates between the isopentane containing patterns and the normal pentane containing patterns is striking for the first 4 days of aging. If one can tolerate the amount of shrinkage that occurs in the normal pentane containing patterns over four aging days, then the isopentane containing patterns could be stored for up to 22 days with the same dimensional change, FIGS. 4A–4E, thereby providing an extended pattern shelf life as compared to normal pentane containing patterns. The change in dimensions of the foam patterns containing normal pentane is over four times greater than the change for foam patterns containing isopentane after four aging days.

FIGS. 5A through 5E display graphs of the average pattern dimensions as a function of pattern blowing agent. A linear relationship was observed between naturally aged pattern dimensions and pattern pentane content, confirming that pattern shrinkage is dependent on blowing agent diffusion.

The blowing agent concentration exerts a strong influence on its diffusion rate. That is, using a slow diffusing isopentane blowing agent is an advantage when one compares shrink rates of the foam patterns with similar levels of other blowing agents. In the case of this example, the concentration of the blowing agent in the expanded beads prior to molding and of the patterns exiting the molding machine was about 3% by weight regardless of the type of blowing agent used. The concentration of isopentane in pre-expanded beads can be reduced using a pentane reduction step as described in U.S. Pat. No. 5,385,698, the teachings of which are incorporated herein by reference.

The following detailed further example is offered to further illustrate, but not limit, the present invention. Experimental raw EPS T type beads pursuant to the invention contained isopentane as the blowing agent and were provided by Styrochem International Corporation, Fort Worth, Tex. The isopentane concentration of the raw EPS beads was 6.27% by weight.

Figure 6:
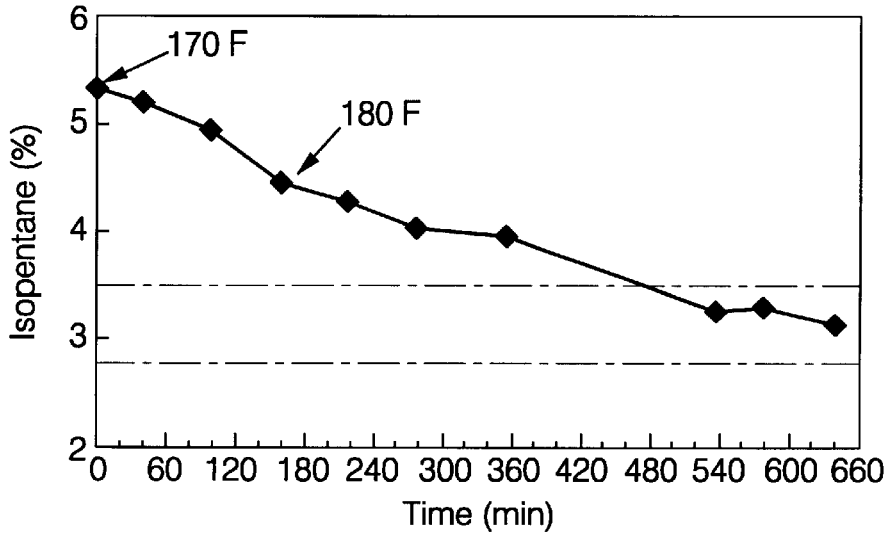
FIG. 6 is a graph of isopentane concentration in the expanded beads with time at 170 degrees F first then at 180 degrees F.
Figure 7A:
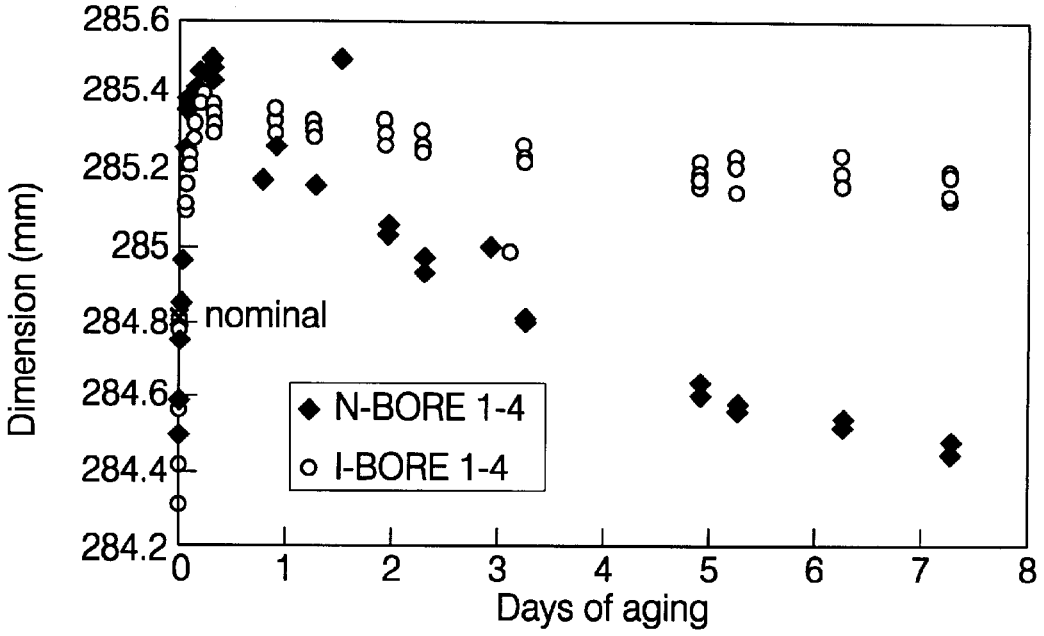
FIGS. 7A through 7D are graphs of bore dimensions (Bore 1–4) and x, y, z pattern dimensions (X Dim, Y Dim, Z Dim) of pattern made with engine water jacket tooling over time of room temperature aging where I represents patterns of the invention including isopentane blowing agent and N represents conventional patterns using normal pentane blowing agent.
Figure 7B:
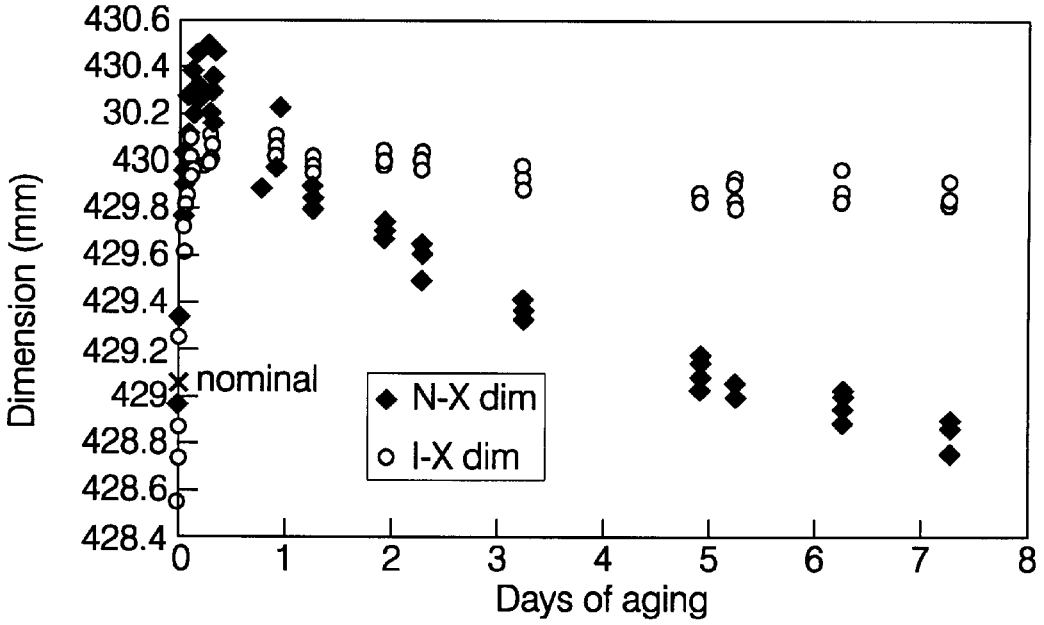
Figure 7C:
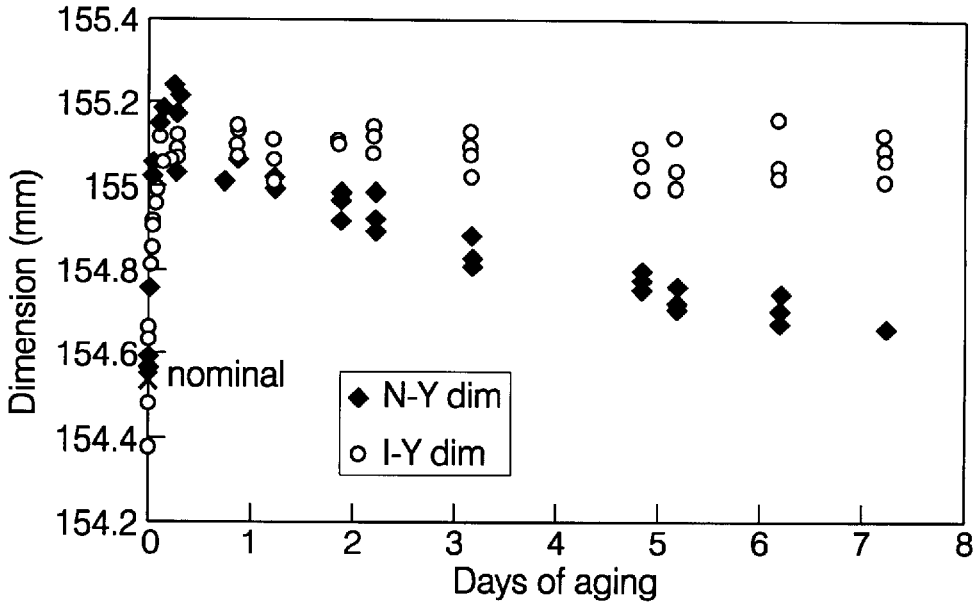
Figure 7D:
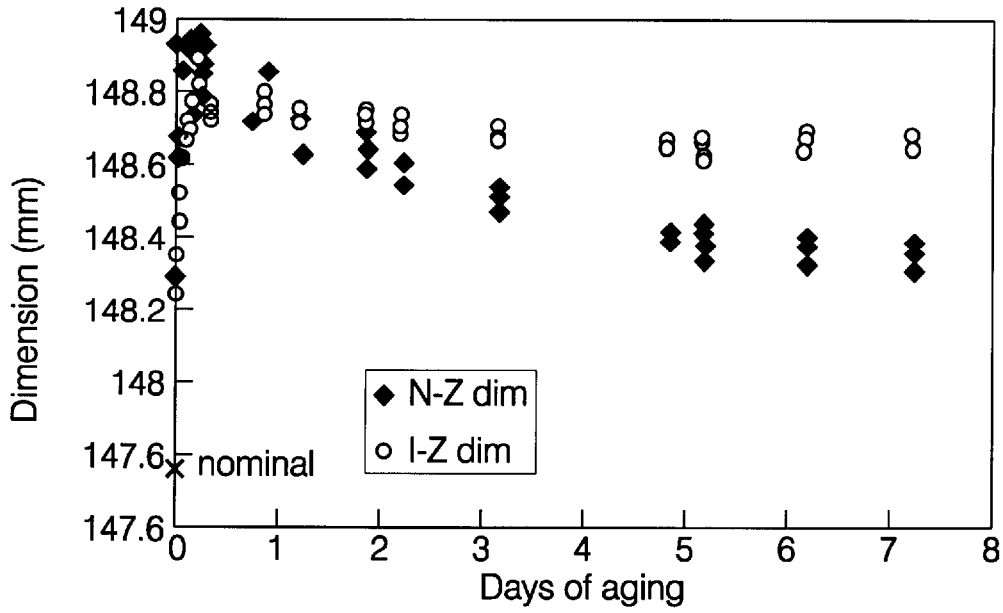

The beads were preexpanded in a Styrologic wet preexpander to a density between 1.27 and 1.31 pcf (pounds per cubic foot). The preexpanded beads were subjected to a isopentane reduction treatment as described in U.S. Pat. No. 5,385,698 at 170 degrees F for the first three hours and 180 degrees F for the next seven hours. The decrease of isopentane content with aging time of the treatment is shown in FIG. 6. The isopentane concentrations were obtained by comparing the weight of the beads before and after aging at 200 degrees C for 15 minutes. The isopentane content was reduced from 5.3% to 3.15% by weight in ten hours. This time can be reduced by use of EPS beads including the 40% by weight normal pentane and 60% by weight isopentane blowing agents described above.

The experimental expanded beads containing 3.15% isopentane and conventional expanded beads containing 3.69% normal pentane and provided by NOVA Chemicals Inc., Monaca, Pa., were molded in Strologic vertical acting, horizontal parting, 100×100 mm molding machines available from Styrologic, a division of Vulcan Engineering Company, Helena, Ala., using standard parameters used heretofore to mold conventional polystirene patterns.

Water jacket patterns were molded using water jacket tooling for a vehicle cylinder block and were used to compare the initial pattern dimensions and the pattern shrink rates. Five EPS water jacket patterns were molded with the expanded beads having isopentane as the blowing agent (3.15% by weight isopentane) and five were molded with the expanded beads having normal pentane as the blowing agent (3.69% by weight normal pentane). The patterns were aged at room temperature for eight days, while four dimensions per pattern were monitored as a function of aging time. These dimensions were bore 1 to bore 4 dimension (bore center to bore center in the x-direction), the average length (x dimension), the average height (y dimension), and the average width (z dimension). The evolution of the dimensions with time is plotted on the graphs of FIGS. 7A through 7D for the first eight aging days. As seen in FIGS. 7A, 7B, 7C, and 7D for the bore center to bore center, x, y, and z dimensions, respectively, the foam patterns made using the EPS beads containing isopentane blowing agent were significantly more dimensionally stable than the foam patterns made with the conventional EPS beads having normal pentane blowing agent, over the eight days of aging.

An entire cylinder block cluster was assembled for lost foam casting and comprised a waterjacket pattern, a crankcase pattern, a bore pattern, and gating, with the patterns being glued together. Four EPS water jackets and four EPS crankcases were molded with the expanded beads having isopentane as the blowing agent (3.15% by weight). Similarly, four EPS water jackets and four EPS crankcases were molded with the expanded beads having the normal pentane as the blowing agent (3.69% by weight). The patterns were aged less than a day before being assembled. Four clusters were assembled using the isopentane waterjacket and crankcase patterns, and four clusters were assembled using the conventional normal pentane waterjacket and crankcase patterns. The bore and gating used in all clusters were molded from conventional normal pentane containing polystirene beads.

The clusters were coated with the commercially available refractory coating Borden SK 400 available from Borden Packaging and Industrial Products, Westchester, Illinois. The eight coated clusters were embedded in dry foundry sand and gravity cast with molten aluminum alloy LF-319.2 at a melt temperature of 1385 degrees F. The average fill times were 39–40 seconds for the clusters including waterjacket and crankcase patterns molded from the EPS beads with isopentane blowing agent versus 37–38 seconds for the clusters including waterjacket and crankcase patterns molded from the EPS beads with normal pentane blowing agent. The castings produced using the clusters including waterjacket and crankcase patterns molded from the EPS beads with isopentane blowing agent were equivalent in visual appearance to the castings using the clusters including waterjacket and crankcase patterns molded from the EPS beads with normal pentane blowing agent.

The present invention provides dimensionally self-stabilized patterns that exhibit an extended shelf life before pattern shrinkage occurs beyond a preselected pattern shrinkage tolerance. The patterns can be used in the lost foam casting process during this extended shelf life without the need for any intermediate stabilizing treatment, such as long term ambient aging, accelerated oven aging, or accelerated vacuum treatment, used heretofore to stabilize post-molding pattern dimensions. Alternately, the patterns can be used shortly after molding to produce more accurate or closer tolerance lost foam castings by virtue of the patterns exhibiting reduced shrinkage rate. Moreover, patterns which have been aged for different periods of time, for example, 1 day and 5 days, can be assembled with good match at the joint.

While the invention has been disclosed in terms of certain embodiments, it is not intended to be limited thereto but rather only to the extent set forth hereafter in the claims which follow.

What is claimed is:

1. In a method of lost foam casting of metal including the principle steps of molding a foam pattern from polystirene beads expanded from raw polystirene beads that have a raw bead diameter from about 0.1 to about 0.6 millimeters and include a blowing agent, embedding said foam in a bed of loose foundry sand to form a loose sand mold about said pattern, and casting a molten metal into said sand mold to vaporize and replace said pattern in said mold, the improvement comprising, said blowing agent comprising at least about 40% by weight of a vaporizable compound having a diffusivity with respect to said pattern comparable to an alkane selected from the group consisting of isopentane, 2,2 dimethylpropane (neopentane), cyclopentane, 2,2 dimethylbutane, 2,3 dimethylbutane, hexane, cyclohexane, 2-methylpentane, and 3-methylpentane, and embedding said pattern in said foundry sand and casting said metal therein without first pretreating said pattern to stabilize it dimensionally.

2. The method of claim 1 wherein a slow-diffusing blowing agent is present in said raw beads together with a blowing agent comprising normal pentane.

3. The method of claim 2 wherein said slow-diffusing blowing agent comprises about 50% to 70% by weight of blowing agent present in said raw beads.

4. The method of claim 3 wherein said slow-diffusing blowing agent comprises about 60% by weight and the normal pentane comprises about 40% by weight of the total of blowing agent present in said raw beads.

5. The method of claim 1 wherein a slow-diffusing blowing agent comprises substantially 100% by weight isopentane.

6. The method of claim 1 wherein a slow-diffusing blowing agent is selected from the group consisting essentially of isopentane, 2,2 dimethylpropane (neopentane), cyclopentane, 2,2 dimethylbutane, 2,3 dimethylbutane, hexane, cyclohexane, 2 methylpentane, 3 methylpentane and mixtures of one with another.

7. The method of claim 1 wherein said blowing agent comprises isopentane.

8. The method of claim 7 wherein said isopentane blowing agent is present in said raw beads together with a normal pentane blowing agent.

* * * * *